United States Patent [19]

Reid

[11] Patent Number: 5,009,433

[45] Date of Patent: Apr. 23, 1991

[54] DART FOR AIMING AT A GAME BOARD

[76] Inventor: Alexander D. Reid, 2378 Eaton Gate, Lake Orion, Mich. 48035

[21] Appl. No.: 444,674

[22] Filed: Dec. 1, 1989

[51] Int. Cl.[5] ..... A63B 65/02

[52] U.S. Cl. ..... 273/419; 273/423

[58] Field of Search ..... 273/420, 419, 416, 423, 273/418; 81/25, 20

[56] References Cited

U.S. PATENT DOCUMENTS

| | | | |
|---|---|---|---|
| 619,762 | 2/1899 | Kissinger et al. | 273/420 |
| 3,130,762 | 4/1964 | Kerr | 81/25 X |
| 3,419,274 | 12/1968 | Tabor | 273/418 |
| 3,701,533 | 10/1972 | Palmer | 273/418 |
| 4,101,126 | 7/1978 | Kurtz et al. | 273/419 X |
| 4,230,322 | 10/1980 | Bottlesen | 273/420 |
| 4,405,133 | 9/1983 | Cartwright, Jr. | 273/419 |
| 4,463,953 | 8/1984 | Jordan | 273/418 |
| 4,697,815 | 10/1987 | McKenna | 273/420 |
| 4,831,901 | 5/1989 | Kinne | 81/20 X |
| 4,842,285 | 6/1989 | Farler | 273/420 |

FOREIGN PATENT DOCUMENTS

| | | | |
|---|---|---|---|
| 86/01418 | 3/1986 | PCT Int'l Appl. | 273/419 |
| 419323 | 11/1934 | United Kingdom | 273/420 |
| 520857 | 5/1940 | United Kingdom | 273/420 |
| 589629 | 6/1947 | United Kingdom | 273/416 |
| 679970 | 9/1952 | United Kingdom | 273/416 |
| 1527631 | 10/1978 | United Kingdom | 273/419 |
| 2029711 | 3/1980 | United Kingdom | 273/416 |
| 2049448 | 12/1980 | United Kingdom | 273/416 |
| 2064967 | 6/1981 | United Kingdom | 273/423 |
| 2133997 | 8/1984 | United Kingdom | 273/423 |
| 2153693 | 8/1985 | United Kingdom | 273/420 |
| 2196267 | 4/1988 | United Kingdom | 273/416 |

OTHER PUBLICATIONS

Sporting Goods Dealer, 10-1976, p. 152, Smart Darts.

*Primary Examiner*—Paul E. Shapiro
*Attorney, Agent, or Firm*—Brooks & Kushman

[57] ABSTRACT

Disclosed is a dart for aiming at a game board comprising a body portion having a tail portion and spaced therefrom a point portion, the point portion being movable on a line with the horizontal longitudinal axis of the body portion and on a line with the vertical axis of the body so that the point can stick to the board and avoid obstructions on the board. Also described is a dart wherein the body of the dart has a cavity containing a movable ballast capable of moving from the tail portion to the point portion for assisting the adherence of the dart to the game board.

12 Claims, 3 Drawing Sheets

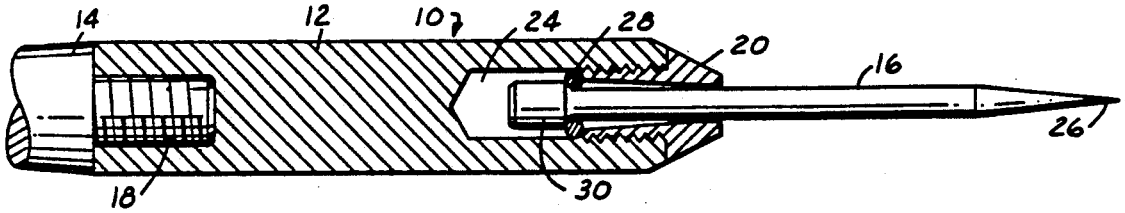
FIG. 1
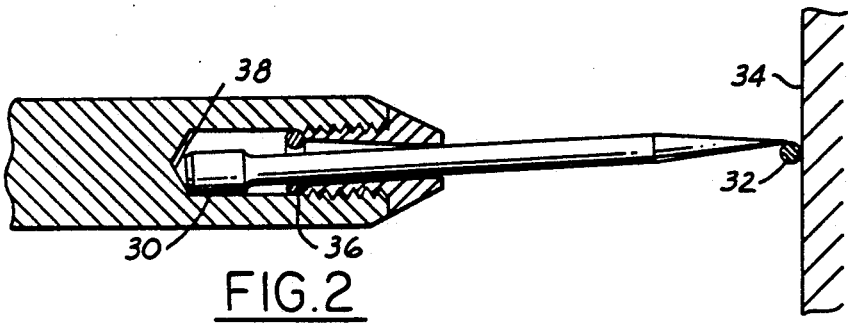
FIG. 2
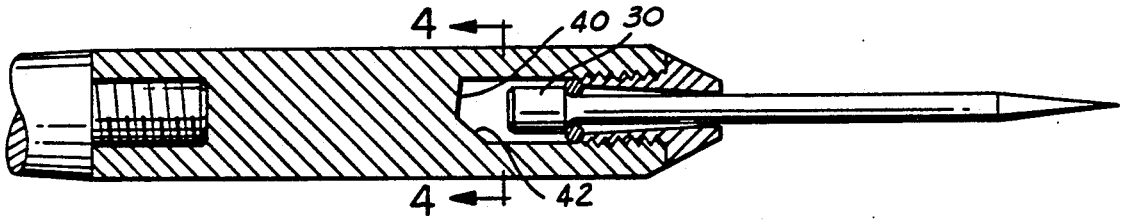
FIG. 3
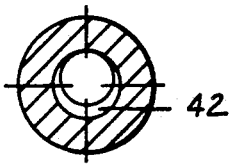
FIG. 4
FIG. 5
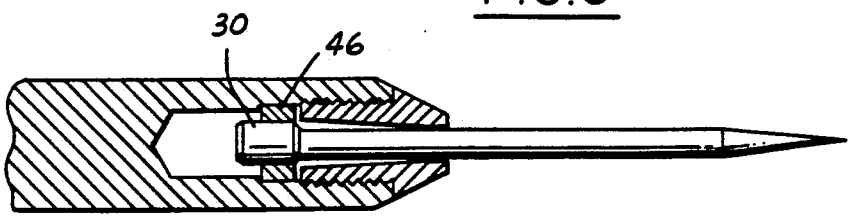

DART FOR AIMING AT A GAME BOARD

TECHNICAL FIELD

The present invention is concerned with a dart that is used in a target game.

BACKGROUND OF THE INVENTION

In a metal tip dart game, a dart is thrown at a target area, typically outlined by a wire grid on the face of the dart board. If a dart point strikes an obstruction like a wire, there is a possibility that the dart will bounce from the target and fall to the floor.

Similarly, in a soft tip or electronic game, the dart is thrown at a target which is honeycombed with holes designed to receive the plastic pointed tips of the dart. The areas between the holes, although tapered to help guide the dart points into the holes, occasionally cause the darts to rebound thereby resulting in no score.

U.S. Pat. No. 4,230,322, Bottelsen, pertains to a no bounce dart having an elongated body with a point sliding in one end of the body and a tail carried at the other end of the body. On impact with a target, the momentum of the body causes the point to slide in the body to a position where the body impacts the head of the point and hammers the point into the target. If an obstruction is hit directly, mere horizontal movement of the point may not be sufficient to prevent dart rebound.

U.S. Pat. No. 1,893,787 pertains to a movable point torpedo dart. A movable tip dart is also shown in U.S. Pat. No. 2,684,851.

U.S. Pat. No. 4,101,126 teaches a dart having a flexible or pivotal point which serves to reduce bounce off.

U.S Pat. No. 4,697,815 discloses a dart having a cavity into which the rear portion of the point can enter, thereby engaging the rear wall of the cavity and shifting the point into the target.

It is an object of this invention to reduce the bounce off of a dart from an obstruction on a target by utilizing a movable point that is capable of moving both horizontally and vertically as compared to the axes of the dart.

It is a further object of the present invention to enhance the adhesiveness of the dart to the target by utilizing movable ballast which enhances the momentum of the dart and permits changing weight and balance of the dart.

SUMMARY OF THE INVENTION

Described is a dart for aiming at a game board comprising:

- a body having a tail portion and, spaced therefrom, a point portion;
- the point portion being movable on a line with the horizontal longitudinal axis of the body and on a line with the vertical axis of the body so that the point can strike the board and avoid an obstruction on the board.

Also described is a dart for aiming at a game board comprising a body having a tail portion and spaced therefrom a point portion;

contained within the body, a movable ballast means capable of moving to the point region for assisting the adherence of the dart to the game board.

BRIEF DESCRIPTION OF THE DRAWINGS

FIG. 1 is an enlarged partial sectional view of a dart having a slidably movable point;

FIG. 2 is a sectional view of the dart of FIG. 1 depicting the movement of the point;

FIG. 3 is an alternative embodiment of FIG. 1 showing an alternative rear cavity area;

FIG. 4 is a sectional view taken along lines 4—4 of FIG. 3;

FIG. 5 is an alternative dart of FIG. 1 showing a variation in the point retainer means;

DESCRIPTION OF THE PREFERRED EMBODIMENTs

Figure 6:
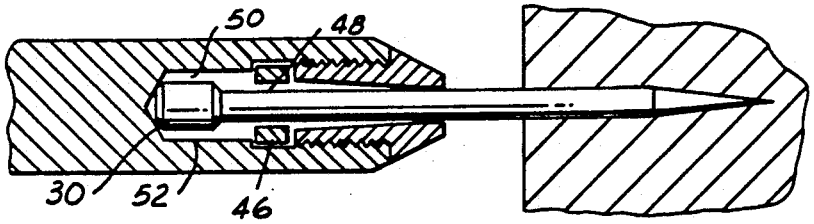
FIG. 6 is the dart of FIG. 5 showing the point having moved within the internal body cavity and being retained in the target.

The dart 10 of the present invention is comprised of a body portion 12 having a tail portion 14 and a tip portion 16. The body 12 is generally comprised of a solid material such as metal where the tail is threadably engaged into the rear portion of the dart shown at 18. The body has a front portion 20 into which the insert 22 is threadably engaged. The body likewise has a cavity portion 24 into which the point 16 snugly fits and is held in place by a retaining means such as an elastomeric O-ring 28. The point 16 has a needle portion 26 and a head portion 30.

As the dart is prepared for aiming towards a target, the point portion is moved forwardly towards the front portion of the dart (towards the right as shown in FIG. 1). When the dart approaches an obstruction 32 on the target 34, the dart point 26 moves around the obstruction and the point portion moves from the right to the left (the back of cavity 24 as shown in FIG. 2).

As can be seen on review of FIG. 2, the point not only moves horizontally along the axis of the body portion, that is, longitudinally along the axis of the body portion, but also moves along the vertical axis of the dart. Elastomeric 0-ring 28 is compressed as shown at reference numeral 36 when the front portion of the point circumvents the obstruction 32.

The shape of the rear portion of the cavity 24 can be adjusted to affect the movement of the hammer portion 30 of the point. A V-shaped portion 38 is shown in FIGS. 1 and 2 which tends to return the point to a central position within the cavity at the end of the travel of the point from right to left after impact with a target. FIG. 3 shows an additional feature to FIGS. 1 and 2. An angled portion 42 acts as a ramp to mechanically move the tip portion 16 along the vertical axis of the dart, each time the dart strikes the target. The angled portion is shown best in FIG. 4.

FIG. 5 shows an alternative retainer means such as a band or bushing 46 which can be a soft metal or a plastic such as nylon or rubber. A metal circlip, which is an incomplete circle of metal, can also be used. As can be seen in contrasting FIGS. 5 and 6, the point portion 16 is retained in position by the retaining means 46 engaging the head portion 30 as shown in FIG. 5. As the dart engages the target, the point moves from the right of FIG. 5 to the left portion of the cavity as shown in FIG. 6.

As can be seen in FIG. 6 at reference numeral 48, there is a space between the retaining means 46 and the point 16. Also, there is a space 50 between the head portion 30 and the interior of the cavity wall 52. This allows for the dart body to be rotated freely, thus offering minimal resistance to the flight of successive darts.

Figure 7:
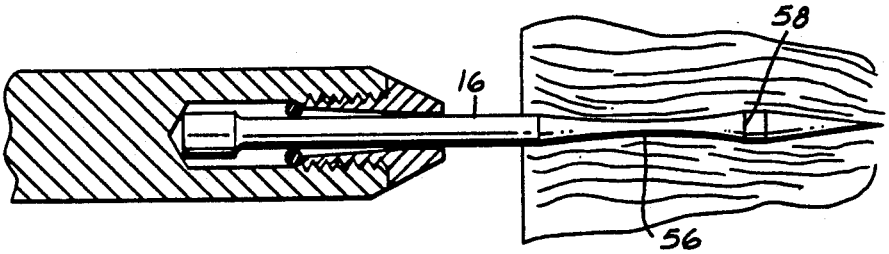
FIG. 7 is an alternative to FIG. 1 showing an improved point.

FIG. 7 shows an alternative to the point 16 having a tapering diameter 56. This tapering diameter is a smaller diameter than the main portion 16 of the point. It also has a smaller diameter than the front portion 58 of the point. The purpose of this tapering diameter point is to decrease the frictional resistance of the point upon entry into the target and once embedded therein, to increase the holding action of the target on the point, thus minimizing the possibility of darts falling out or being knocked out by successive darts. Another way to describe the point 16 of FIG. 7 is that the portion of the pointed front end of the needle that is exposed (not within cavity 24) has one or more portions with reduced dimensions.

Figure 8:
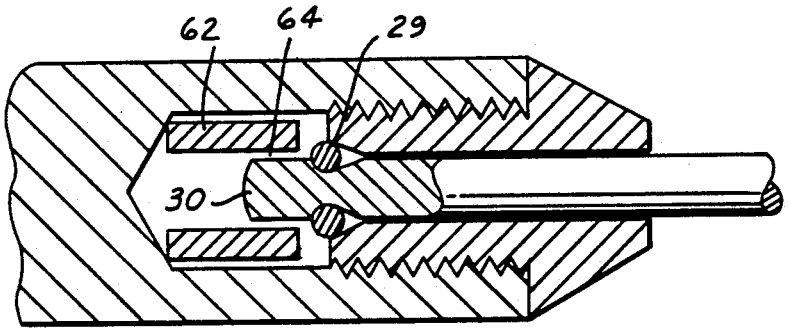
FIG. 8 is an alternative to FIG. 1 wherein the head portion of the point has a recessed area for holding the dart point in position.
Figure 9:
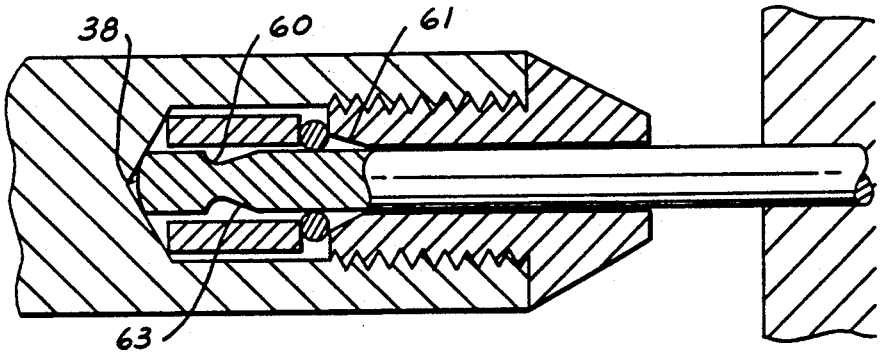
FIG. 9 is the dart of FIG. 8 wherein the point has moved rearwardly in the internal cavity of the dart.

FIGS. 8 and 9 show an alternative technique for retaining the head portion of the point. The internal cavity of the dart has a retaining means 29 which is positioned within the grooved area 60 of the rearward portion of the point.

By virtue of the frictional engagement of the retaining means 29 about the shaft of the point, the point is held in place. This retaining means can be a split metal circlip or an 0-ring. Included within the body cavity is a cylindrical bushing 62 which can be comprised of metal, plastic, or rubber. Note that there is still a spacing between the head 30 and the bushing 62 as is shown by reference numeral 64. FIG. 9 shows the rearward movement of the point shaft from the right to the left as shown in comparing FIGS. 8 and 9. As the point shaft moves rearwardly, the tapered diameter 63 of the groove 60 expands the resilient member 29 allowing the point to pass through and contact the cavity end wall 38. Forward point movement is limited as shown in FIG. 8, because the resilient member contacts the tapered diameter of the passage 61 and is thus held firmly in the groove.

Figure 10:
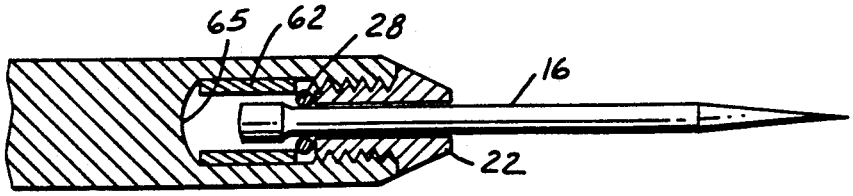
FIG. 10 is another alternative to the retaining means shown in FIGS. 1 to 9.

FIG. 10 is an alternative design showing the retaining means 28 as an 0-ring and being contained around the point between the bushing 62 and the insert 22. This method of containing the retaining means 28 could be employed equally for the darts shown in FIGS. 1, 2, 3, 5, 6 and 7. The rear wall 65 of the cavity is shaped to conform to the shape of the head 30. Bushings of varying lengths and retaining means of different widths can be used to adjust the frictional force of the retaining means upon the shaft by changing the extent to which the retaining means is compressed and thus deformed against the point 16.

Figure 11:
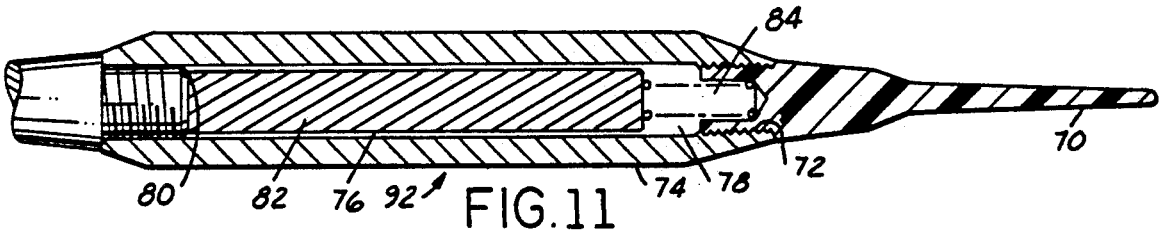
FIG. 11 is a dart of the present invention showing the movable ballast means.
Figure 12:
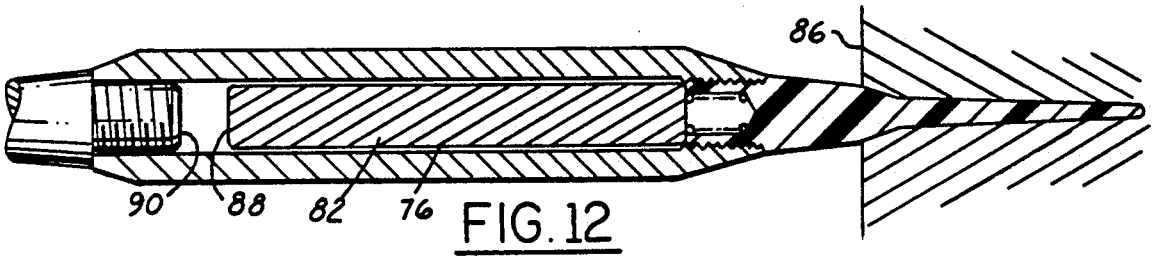
FIG. 12 is the dart of FIG. 11 wherein the ballast has moved forwardly in the cavity of the dart.

Referring now to FIGS. 11-14, these are generally characterized as darts that comprise a plastic point 70 which is threadably engaged at 72 with the metal body portion 74. The body has a substantially larger internal cavity 76 than that of FIG. 1. This cavity has a front portion 78 and a rearward portion 80. Contained within the body cavity is a ballast means 82 which is shown in FIG. 11 as a solid metal slug being retained in the rearward position by the spring 84. When contrasting FIGS. 11 and 12, the ballast portion moves from the left as shown in FIG. 11 to the right as shown in FIG. 12 thereby compressing the spring 84 and assisting the dart to be retained in target 86. Note that there is a separation between the rear portion of the ballast 88 and the threaded tail portion 90. This therefore shows the amount of distance the ballast has moved during the aiming of the dart 92. The movable ballast permits increased momentum to assist the dart in being retained in the target board.

Figure 13:
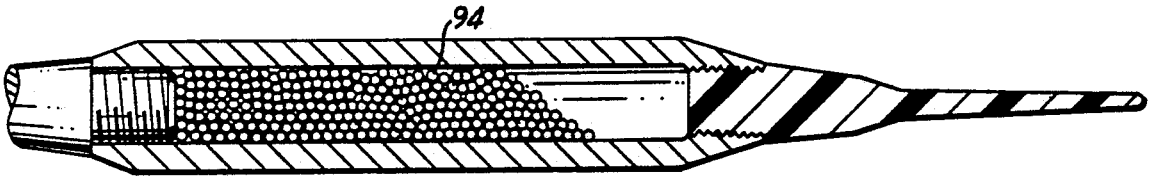
FIG. 13 is an alternative to the ballast means utilized in the dart of FIG. 11.

FIG. 13 shows an alternative to the solid slug of FIGS. 11 and 12, namely a collection of metal balls or shot 94 which moves from the left to the right as the dart impacts the target. The shot stops the bounce of the dart from the board.

Figure 14:
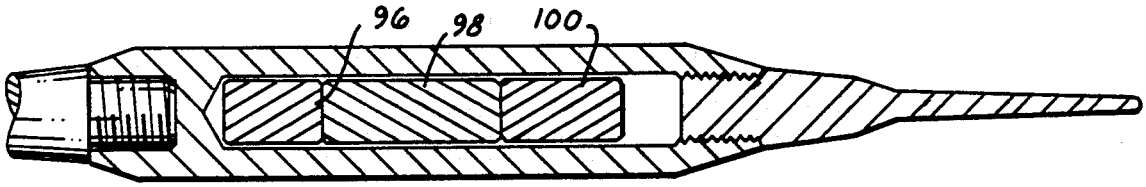
FIG. 14 is an alternative to the ballast means utilized in the dart of FIG. 11.

FIG. 14 also shows variations in the ballast means by utilizing multiple metal slugs. In this FIG. 3 slugs, 96, 98 and 100. These metal slugs can move independently or in unison as they go from the rest position as shown in FIG. 14 to the right as the dart would strike the target (not shown). The slugs can vary in material and density and size, thus enabling their interchangeability to affect the overall weight of the dart and the balance of that weight within the dart.

While the ballast means that has been described as to the plastic point darts, it is equally to be appreciated that it may be used with the metal tipped darts as well with equal proficiency as to reducing rebounds, and changing the overall weight of the dart and the balance of the weight within the dart.

Figure 15:
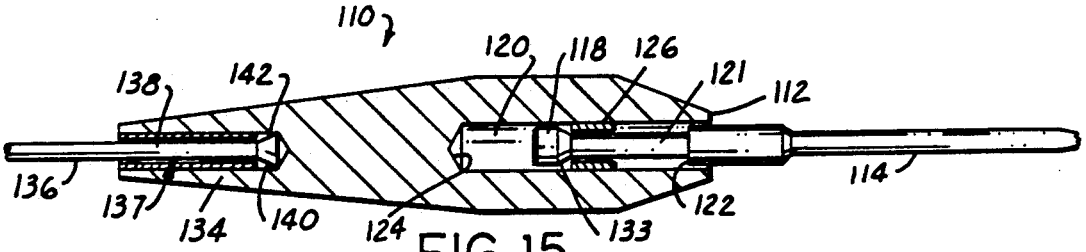
FIG. 15 is an alternative dart of the present invention showing a cross sectional view with a rotatable tail portion.
Figure 16:
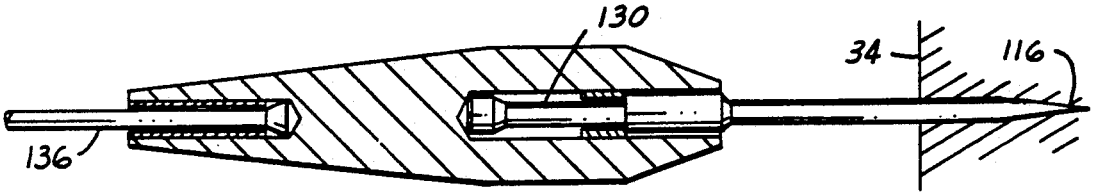
FIG. 16 is the dart of FIG. 15 showing the movement of the point into the cavity of the body.

Turning now to FIGS. 15 and 16, these are alternatives to the invention described herein. These Figures show the dart without a threadably engaging point. The darts 110 have a front portion 112 into which is inserted the point portion 114 having a needle tip 116 and a rearward head portion 118 which fits within cavity 120 of the dart. The needle has a groove 121 with a shoulder portion 122 and a tapered diameter 133. When the dart strikes the target 34 (FIG. 16), the needle moves into the interior of the cavity of the dart. The point moves from the right to the left as shown in FIG. 16, whereby the head 118 of the point strikes the rearward portion 124 of the cavity. Upon withdrawing the dart from the target, the point portion moves to the right and the tapered diameter 133 of the needle pushes the retainer means 126 outward against the cavity wall and increases the frictional force between the retainer means and the cavity, thus preventing further needle movement to the right. The retainer means 126 can be made of a number of materials such as metal, plastic or rubber or can be a metal circlip.

The tail portion 134 of the dart can be comprised of any well known configuration for a threadably engaged tail portion as described in FIGS. 1 through 14. An alternative embodiment is a rotatable tail 136 having a shaft 138 and a head with a tapered diameter 142. The tail is positioned in a bushing 137 which fits snugly in the axial passage 140 of the tail portion 134 of the dart. The bushing can be made of plastic, rubber or metal.

The design of FIGS. 15 and 16 show that the shaft 138 may rotate about the longitudinal axis of the tail 136, thereby permitting other subsequently tossed darts to not be interfered with by a rigid tail portion. The tapered diameter of the head prevents the tail from easily pulling out by pushing the bushing outward against the axial passage, thus increasing the frictional holding resistance of the bushing in the passage.

While the forms of the invention herein disclosed constitute presently preferred embodiments, many others are possible. It is not intended herein to mention all of the possible equivalent forms or modifications or ramifications of the invention. It is understood that the terms used herein are merely descriptive rather than limiting and that various changes may be made without departing from the spirit or scope of the invention.

What is claimed is:

1. A dart for aiming at a game board comprising:

a body portion having a tail portion and spaced therefrom a point portion;

the point portion being movable on a line with the horizontal longitudinal axis of the body portion and on a line with the vertical axis of the body so that the point can stick to the board and avoid obstructions on the board;

wherein the body has a cavity in which the point portion moves as the point engages the target;

a ramp situated at the rear of the cavity causes the point portion to move on a line with the vertical axis of the body when the dart strikes the target; and the point portion having a needle portion and a head portion wherein the head portion is retained in place by an elastomeric compressible engaging means which is in direct contact with the point portion.

2. The dart of claim 1 wherein the engaging means is compressed when the needle portion of the point avoids an obstruction in the target.

3. The dart of claim 1 wherein the point portion is comprised of a head portion which fits within a cavity of the body; and wherein said engaging means fits snugly about the head to retain the point in position.

4. The dart of claim 1 wherein the point portion has a head portion that fits within the cavity of the body portion of the dart, the head portion having a groove, said engaging means comprising a retaining ring fitted in said groove to securely hold the point portion in place.

5. The dart of claim 1 wherein the elastomeric compressible engaging means forms a direct seal between the point portion and the body portion, and is of predetermined dimensions and elastomeric properties to maintain the seal, as the point portion moves into the cavity,

6. The dart of claim 5 wherein the elastomeric means is an O-ring.

7. A dart comprising:

a body portion having a tail portion and spaced therefrom a point portion and contained within the body portion, a cavity connected to the front of the body portion by an axial passage being contained in a nose that is threadably securable to the body portion;

the point portion having a shaft portion and a head portion, and the shaft portion being movable in the passage on a line with the longitudinal axis of the body portion and the head portion being contained within the cavity; and a resilient retaining means being situated within the cavity and positioned snugly around the shaft portion and being compressed uniformly along the longitudinal axis of the body portion between the rear face of the nose and the front face of a cylindrical bushing within the cavity to produce an increased frictional retaining force between the shaft portion and the resilient means;

the cylindrical bushing being changeable for bushings of different lengths to adjust the amount of compression of the resilient means and thus adjust the frictional forces of the resilient means on the shaft portion.

8. A dart comprising:

a unitary body portion having an axial passage leading from the front portion of the body to the interior of the body; and a point portion, slidably retained in the passage which can move from an extended position to the interior portion of the body portion;

the point portion has a head portion that fits within the passage of the body portion of the dart, the head portion having a groove with a forwardly tapering diameter at the rear end of the groove; and a resilient retaining means is situated within the groove of the head portion, which also fits snugly against the walls of the passage of the body, the retaining means limiting the forward movement by being pressed against the passage walls by the forwardly tapering diameter thus increasing the frictional force between the passage walls and the retaining means and the difference in dimension between the width of the groove and the axial length of the retaining means determining the total axial movement of the point portion within the passage.

9. The dart of claim 8 wherein the resilient retaining means is elastomeric tubing.

10. The dart of claim 8 wherein the resilient retaining means is a metal circlip.

11. A dart comprising:

a body portion having a tail portion and spaced therefrom a point portion;

contained within the body, a cavity connected to the front of the body portion by an axial passage, and contained within the cavity a cylindrical bushing;

the point portion being movable in the passage on a line with the horizontal longitudinal axis of the body portion, and having a head portion that is positioned in the bushing;

the head portion having a groove in which a resilient retaining means fits to hold the point portion in an extended position and wherein said groove having a forward side with a rearwardly tapering diameter allowing rearward movement of the point portion by expansion of the retaining means; and wherein the point portion is restrained from forward movement beyond the extended position by a forwardly tapering diameter connecting the cavity and passage which proportionally converts the forces pulling on the point portion into forces acting to contain the retaining means within the groove.

12. The dart of claim 11 wherein the passage is contained within a nose being threadably securable to the front end of the body portion, and wherein the retaining means is a metal circlip.

* * * * *